US006162578A

United States Patent [19]

Zheng et al.

[11] Patent Number: 6,162,578

[45] Date of Patent: Dec. 19, 2000

[54] IMAGING MEMBER CONTAINING HEAT SENSITIVE HYPERBRANCHED POLYMER AND METHODS OF USE

[75] Inventors: Shiying Zheng, Rochester; Thap DoMinh, Webster; Jin-Shan Wang, Rochester, all of N.Y.

[73] Assignee: Eastman Kodak Company, Rochester, N.Y.

[21] Appl. No.: 09/215,394

[22] Filed: Dec. 18, 1998

[51] Int. Cl.[7] ..... G03C 1/725

[52] U.S. Cl. ..... 430/270.1; 430/302

[58] Field of Search ..... 430/270.1, 302

[56] References Cited

U.S. PATENT DOCUMENTS

| | | | |
|---|---|---|---|
| 3,650,743 | 3/1972 | Hallman et al. | 96/33 |
| 3,964,389 | 6/1976 | Peterson | 101/467 |
| 4,034,183 | 7/1977 | Uhlig | 219/122 |
| 4,081,572 | 3/1978 | Pacansky | 427/53 |
| 4,115,127 | 9/1978 | Ikeda et al. | 96/85 |
| 4,405,705 | 9/1983 | Etoh et al. | 430/270 |
| 4,634,659 | 1/1987 | Esumi et al. | 430/302 |
| 4,693,958 | 9/1987 | Schwartz et al. | 430/302 |
| 5,460,918 | 10/1995 | Ali et al. | 430/200 |
| 5,512,418 | 4/1996 | Ma | 430/271.1 |
| 5,569,573 | 10/1996 | Takahashi et al. | 430/138 |
| 5,587,441 | 12/1996 | Frechet et al. | 526/238 |
| 5,587,446 | 12/1996 | Frechet et al. | 526/333 |
| 5,763,548 | 6/1998 | Matyjaszewski et al. | 526/135 |
| 5,985,514 | 11/1999 | Zheng et al. | 430/270.1 |

FOREIGN PATENT DOCUMENTS

| | | | |
|---|---|---|---|
| 0 652 483 A1 | 11/1993 | European Pat. Off. | G03F 7/004 |

*Primary Examiner*—Janet Baxter
*Assistant Examiner*—Barbara Gilliam
*Attorney, Agent, or Firm*—J. Lanny Tucker

[57] ABSTRACT

An imaging member is composed of a heat-sensitive imaging layer having a heat-sensitive hyperbranched polymer containing heat-sensitive active end groups, and optionally a photothermal conversion material. Upon application of energy that generates heat, such as from IR irradiation, the polymer is rendered either more hydrophobic or hydrophilic depending upon the type of heat-sensitive active end groups present in the polymer. The exposed imaging member can be contacted with a lithographic printing ink and used for printing with or without post-imaging wet processing. This imaging member is particularly useful for direct write imaging using IR lasers or thermal printing heads.

24 Claims, No Drawings

IMAGING MEMBER CONTAINING HEAT SENSITIVE HYPERBRANCHED POLYMER AND METHODS OF USE

FIELD OF THE INVENTION

This invention relates in general to lithographic imaging members, and particularly to heat-sensitive imaging members that can be used with or without wet processing after imaging. The invention also relates to a method of digitally imaging such imaging members, and to a method of printing using them.

BACKGROUND OF THE INVENTION

The art of lithographic printing is based upon the immiscibility of oil and water, wherein an oily material or ink is preferentially retained by an imaged area and the water or fountain solution is preferentially retained by the nonimaged areas. When a suitably prepared surface is moistened with water, and ink is then applied, the background or nonimaged areas retain the water and repel the ink while the imaged areas accept the ink and repel the water. The ink is eventually transferred to the surface of a suitable substrate, such as cloth, paper or metal, thereby reproducing the image.

Very common lithographic printing plates include a metal or polymer support having thereon an imaging layer sensitive to visible or UV light. Both positive- and negative-working printing plates can be prepared in this fashion. Upon exposure, and perhaps post-exposure heating, imaged or nonimaged areas are removed using wet processing chemistries.

Thermally sensitive printing plates are less common but becoming more prominent. Examples of such plates are described in U.S. Pat. No. 5,372,915 (Haley et al). They include an imaging layer comprising a mixture of dissolvable polymer s and an infrared radiation absorbing compound. While these plates can be imaged using lasers and digital information, they require wet processing using alkaline developer solutions after imaging.

Thus, conventional preparation of lithographic printing plates generally involves multiple processing steps such as exposure to irradiation and subsequent chemical processing. "Direct write" eliminates the use of patterned light image and the process used to generate such image. "Direct write" using an infrared laser is a thermally driven process and is more desirable because the imaging laser heats only small regions at a time. Moreover, computer control allows for high resolution images to be generated at high speed such the images can be produced directly on a printing plate pixel by pixel. The chemical processing steps are also avoided. Thus, thermal "direct write" processless lithographic printing plates and methods of images are in demand in the industry.

It has been recognized that a "direct write" lithographic printing plate could be created containing an IR absorbing layer. For example, Canadian 1,050,805 (Eames) discloses a dry planographic printing plate comprising an ink receptive substrate, an overlying silicone rubber layer, and an interposed layer comprised of laser energy absorbing particles (such as carbon particles) in a self-oxidizing binder (such as nitrocellulose). The plate was developed by applying naphtha solvent to remove debris from the exposed image areas. Similar plates are described in *Research Disclosure* 19201, 1980 as having vacuum-evaporated metal layers to absorb laser radiation in order to facilitate the removal of a silicone rubber overcoated layer. These plates were developed by wetting with hexane and rubbing. Other ablation imaging processes are described for example in U.S. Pat. No. 5,385,092 (Lewis et al), U.S. Pat. No. 5,339,737 (Lewis et al), U.S. Pat. No. 5,353,705 (Lewis et al), US Reissue 35,512 (Nowak et al) and U.S. Pat. No. 5,378,580 (Leenders).

While the noted printing plates used for digital, processless printing have a number of advantages over the more conventional photosensitive printing plates, there are a number of disadvantages with their use. The process of ablation creates debris and vaporized materials that must be collected. The laser power required for ablation can be considerably high, and the components of such printing plates may be expensive, difficult to coat, or unacceptable in resulting printing quality. Such plates generally require at least two coated layers on a support.

A variety of materials and methods have been used to prepare thermal direct write lithographic printing plates. Thermal direct write plates that require an aqueous processing step are known. For example, U.S. Pat. No. 5,512,418 (Ma) describes the use of cationic polymers containing pendant ammonium groups for thermally-induced imaging. However, such plates require aqueous processing steps after imaging.

Similarly, U.S. Pat. No. 4,693,958 (Schwartz et al) discloses a method of preparing litho printing plates which also require aqueous processing by using polyamic acids and vinyl polymers containing pendant quaternary ammonium groups. Nonthermal wet processing printing plates are also reported in U.S. Pat. No. 4,405,705 (Etoh et al). Resin composition comprising basic polymers and organic carboxylic acids are exposed to ultraviolet lights and developed with water to produce negative-working plates.

U.S. Pat. No. 4,081,572 (Pacansky) describes the preparation of lithographic printing masters employing hydrophilic polyamic acids that can be selectively converted to hydrophobic polyimides imagewise by heat. However, the laser exposure was applied through a transparency mask, that is an image-bearing transparency and hence it is not a "direct write" printing plate.

Processless plates have also been prepared by changing the surface tension of resin compositions as described in U.S. Pat. No. 4,634,659 (Esumi et al). Photooxidation-sensitive resins such as polystyrene and polyethylene were exposed to ultraviolet lights and the imaged area became hydrophilic to repel ink due to the oxidation and the roughness of the surface. However, this is not a thermal process. Altering surface tension has also been applied to U.S. Pat. No. 4,034,183 (Uhlig). This patent discloses the method to produce thermal direct write processless plates using a high power laser. However, printing plates prepared using differentiation of surface tension suffer from poor physical properties and limited run lengths.

U.S. Pat. No. 3,650,743 (Hallman et al) and U.S. Pat. No. 4,115,127 (Ikeda et al) describe methods of preparing processless litho printing plates using inorganic materials. However, both imaging members are multiple-layer structures and some of them use toxic materials such as arsenic and others require vacuum deposition of mixed inorganic coating materials. Moreover, both are not thermally-imageable plates.

Thermal or laser mass transfer is another method of preparing processless litho printing plates. U.S. Pat. No. 5,460,918 (Ali et al) discloses a process of thermally transferring a hydrophobic image from a donor sheet to a microporous hydrophilic crosslinked silicated surface of the receiver sheet. In another example, U.S. Pat. No. 3,964,389 (Peterson) describes a process of laser transferring an image from donor to receiver but requires high temperature postheat. Both processes require donor and receiver sheets and have practical disadvantages of maintaining extremely clean surfaces during transfer.

U.S. Pat. No. 5,569,573 (Takahashi et al) describes a new method for production of thermal direct write processless litho printing plates. The coating comprises a hydrophilic three-dimensional cross-linked binder and a microcapsuled hydrophobic material. Upon heating, the microcapsule ruptures and forms a hydrophilic image.

Thermally switchable polymers have been described for use as imaging materials in printing plates. By "switchable" is meant that the polymer is rendered either more hydrophobic or hydrophilic upon exposure to heat. EP-A 0 652 483 (Ellis et al) describes a process of preparing thermal direct write processless plates using polymers containing acid- or heat-labile pendant hydrophobic groups which becomes hydrophilic upon heating. However, polymers of this kind suffer from short shelf life and are difficult to manufacture.

Up until the present, heat-sensitive polymers used in printing plates are linear polymers. There is a need to provide heat-sensitive materials that are more durable and heat-sensitive in the imaging and printing operations.

Compared with linear polymers, dendritic polymers (dendrimers) provide some unique advantages (Frechet et al, *Science*, 1995, 269, 1080). First, the intrinsic viscosity of dendrimer is lower compared with linear analog with the same molecular weight. Second, the level of interaction between solvent and polymer is decreased and polymer becomes much more compact. Third, if the functional groups are located at the termini of dendrimer, the functional group becomes more accessible and occupies much higher surface area.

Since the regularly branched dendrimers were prepared only through lengthy multi-step syntheses, their availability is limited to a small group of functional monomers and industrial production of dendrimers is therefore limited.

Compared to a dendrimer, a hyperbranched polymer is less regular. However. it might approximate at least some of the desirable properties of dendrimers (Frechet et al. *J. Macromol. Sci., Pure Appl. Chem.* 1996, A33, 1399). More importantly, hyperbranched polymers are more conducive to industrial applications. Hyperbranched polymers made by condensation reactions have been suggested (Kim, et al., *J. Am. Chem. Soc.* 1990, 112, 4592, and Hawker, et al. ibid, 1991, 113, 4583). Frechet et al discovered that a large numbers of vinyl monomer based hyperbranched polymers can be obtained by means of living chain polymerization of branching vinyl monomer (U.S. Pat. No. 5,587,441 and U.S. Pat. No. 5,587,446 both of Frechet et al). Since their discovery, various vinyl hyperbranched polymers have been prepared by living cationic polymerization (U.S. Pat. No. 5,587,441), atom transfer radical polymerization (U.S. Pat. No. 5,763,548 of Wang et al), group transfer polymerization [Muller et al, *Polymer Preprint*, 1997, 38(1), 4981], and stable radical polymerization (Hawker et al, *J. Am. Chem. Soc.* 1991, 11, 4583). The resultant vinyl hyperbranched polymer from living chain polymerization is a totally different class of materials from the dendrimer and its derivatives in terms of both chemical composition and macromolecular architecture.

Vinyl hyperbranched polymers with different structures, such as random copolymer (Gaynor, et al. *Macromolecules*, 1996, 29, 1079), grafted hyperbranched copolymer (U.S. Ser. No. 09/105,767, Kodak Docket No. 77710), and block hyperbranched copolymer (U.S. Ser. No. 09/105,765, Kodak Docket No. 77708), have been made by atom transfer radical polymerization process.

The graphic arts industry is seeking alternative means for providing a direct write, negative- or positive-working lithographic printing plate with high sensitivity, high imaging speed, long shelf life and press life, that can be imaged without ablation and the accompanying problems noted above. The heat-sensitive polymers used for this purpose until this time have not fully met all of the needs of the industry.

SUMMARY OF THE INVENTION

The problems noted above are overcome with an imaging member comprising a support having thereon a heat-sensitive imaging layer comprising a heat-sensitive hyperbranched polymer.

This invention also includes a method of imaging comprising the steps of:

A) providing the imaging member described above, and

B) imagewise exposing the imaging member to provide exposed and unexposed areas in the imaging layer of the imaging member, whereby the exposed areas are rendered either more hydrophobic or more hydrophilic than the unexposed areas by the heat generated by the imagewise exposing.

Preferably, the method is carried further with the step of:

C) contacting the imagewise exposed imaging member with a lithographic printing ink, and imagewise transferring the printing ink from the imaging member to a receiving material.

Thus, in one embodiment, the imaging member is exposed to provide heat exposed areas that are rendered more hydrophilic than the unexposed areas. In another embodiment, the heat exposed areas are rendered more hydrophobic than the unexposed areas. With the teaching provided herein and routine experimentation, a skilled artisan would be able to determine what types of heat-sensitive hyperbranched polymers and heat-sensitive active end groups (defined below as "Fr") would be rendered more hydrophilic or more hydrophobic upon exposure to heat.

The imaging member of this invention has a number of advantages, thereby avoiding the problems of known printing plates. Specifically, the problems and concerns associated with ablation imaging (that is, imagewise removal of surface layer) are avoided because imaging is accomplished by "switching" (preferably ineversibly) the exposed areas of its printing surface.

In one embodiment, the exposed areas are rendered more hydrophobic, or oil-receptive by heat generated or provided during exposure to an appropriate energy source. The resulting imaging members display high ink receptivity in exposed areas and excellent ink/water discrimination.

In other embodiments, the exposed areas are rendered more hydrophilic, or water-receptive by the heat generated or provided during exposure to an appropriate energy source.

The imaging members perform well with or without wet chemical processing after imaging to remove the unexposed areas. Preferably, no wet chemical processing (such as processing using an alkaline developer) is used in the practice of this invention after imaging. The imaging members are capable of long run length because the exposed areas are not only "switched" in their chemical nature, but in some instances, they may also be crosslinked. The printing members resulting from the method of this invention are generally negative-working, but can also be positive-working depending upon the type of hyperbranched polymers and heat-sensitive active ends groups used therein.

These advantages are achieved by using a specific hydrophilic heat-sensitive hyperbranched polymer in the imaging layer. These polymers have heat-sensitive active end groups described in more detail below. The polymers are known as hyperbranched polymers and contain multiple branching that includes the heat-sensitive sites needed for imaging. These heat-sensitive sites enable the imaging layer to become either more hydrophilic or hydrophobic upon exposure to heat, depending upon the type of heat-sensitive sites and polymers used. In addition. the high level of branching provides lower viscosity and a higher accessibility of heat-sensitive functional groups for imaging.

DETAILED DESCRIPTION OF THE INVENTION

The imaging members of this invention comprise a support and one or more layers thereon that are heat-sensitive. The support can be any self-supporting material including polymeric films, glass, metals or stiff papers, or a lamination of any of these materials (such as a ceramic laminated polyester support). The thickness of the support can be varied. In most applications, the thickness should be sufficient to sustain the wear from printing and thin enough to wrap around a printing form. A preferred embodiment uses a polyester support prepared from, for example, polyethylene terephthalate or polyethylene naphthalate, and having a thickness of from about 100 to about 310 $\mu$m. Another preferred embodiment uses a metal (such as aluminum, chromium or stainless steel) sheet having a thickness of from about 100 to about 600 $\mu$m. The support should resist dimensional change under conditions of use. The aluminum and polyester supports are most preferred for lithographic printing plates.

The support can also be a cylindrical surface having the heat-sensitive imaging polymer composition coated thereon, and can thus be an integral part of the printing press. The use of such cylinders is described for example in U.S. Pat. No. 5,713,287 (Gelbart).

The support may be coated with one or more "subbing" layers to improve adhesion of the final assemblage. Examples of subbing layer materials include, but are not limited to, gelatin and other naturally occurring and synthetic hydrophilic colloids and vinyl polymers (such as copolymers prepared from vinylidene chloride) that are known for such purposes in the photographic industry vinylphosphonic acid polymers, alkoxysilanes, aminopropyl triethoxysi lane, glycidoxypropyltriethoxysilane, sol-gel materials, epoxy functional polymers and ceramics.

The backside of the support may be coated with antistatic agents and/or slipping layers or matte layers to improve handling and "feel" of the imaging member.

The imaging member, however, preferably has only one layer, that is the heat-sensitive imaging layer that is required for imaging. The hydrophilic imaging layer includes one or more heat-sensitive polymers (as described below), and preferably in addition, that layer includes a photothermal conversion material (described below). Preferably it provides the outer printing surface.

In the heat-sensitive imaging layer of the imaging members, only the heat-sensitive hyperbranched polymer and optionally the photothermal conversion material are necessary or essential for imaging.

Each of the heat-sensitive hyperbranched polymers useful in this invention has a molecular weight of at least 200, preferably of at least 500 and most preferably of at least 8000. The upper limit of the molecular weight can be extremely high because of their highly branched nature. However, generally the molecular weight is up to 10,000,000, preferably up to 1,000,000 and most preferably up to 100,000. The polymers are preferably vinyl homopolymers or copolymers prepared from one or more ethylenically unsaturated polymerizable monomers that are reacted together using known polymerization techniques and reactants. Alternatively, they can be addition homopolymers or copolymers (such as polyethers) prepared from one or more heterocyclic monomers that are reacted together using known polymerization techniques and reactants. Additionally, they can be condensation type polymers (such as polyesters, polyimides, polyamides or polyurethanes) prepared using known polymerization techniques and reactants.

The heat-sensitive hyperbranched polymers useful in the practice of this invention comprise at least one hyperbranched polymer segment [HBP-$(Fr)_n$] with multiple (n is 2 or more) heat-sensitive active end groups "Fr". The hyperbranched segment may comprise any type of polymer segment (HBP) with hyperbranched architecture. Such heat-sensitive active end groups have the function of providing either more hydrophilicity or hydrophobicity when heated during imaging. The various mechanisms for these properties achieved during heating are not readily understood at this time.

Examples of hyperbranched architectures include but not limited to, hyperbranched homopolymer and hyperbranched random copolymers such as those described in U.S. Pat. No. 5,587,441 (noted above) and U.S. Pat. No. 5,587,446 (noted above), both incorporated herein by reference. Also useful are hyperbranched block copolymers such as those disclosed in U.S. Ser. No. 09/105,767, filed Jun. 26, 1998, by Jin-Shan Wang, and hyperbranched graft copolymers such as those disclosed in U.S. Ser. No. 09/105,765, filed Jun. 26, 1998, by Jin-Shan Wang, the disclosures of both of which are incorporated by reference in their entirety herein.

In U.S. Ser. No. 09/105,767, hybrid hyperbranched block copolymers are described as being prepared from a "macro-initiator" comprising a hyperbranched polymer segment having multiple functionalized end group initiating sites, and a solution of monomers or macromonomers that are copolymerized therewith.

In U.S. Ser. No. 09/105,765, hyperbranched-graft hybrid copolymers are described as being prepared by radically copolymerizing a solution of at least one branching vinyl monomer and at least one non-branching vinyl macromonomer.

A wide variety of known polymerization methods can be used to produce a hyperbranched architecture in hyperbranched polymers. In accordance with preferred embodiments, the hyperbranched segments of the hyperbranched polymer are obtained through a living/controlled polymerization of one or more special monomers (that are referred to herein as "branching monomer") that can be copolymerized with or without additional non-branching monomers or macromonomers. Possible polymerization techniques include, but not limited to, stable radical polymerization, atom transfer radical polymerization (identified herein as "ATRP"), anionic polymerization, cationic polymerization, coordination polymerization, group transfer polymerization, ring opening polymerization, and condensation polymerization. In preferred embodiments, the hyperbranched segments are obtained through a radical polymerization process, such as stable radical polymerization or atom transfer radical polymerization (ATRP).

In particularly preferred embodiments of the invention, hyperbranched segments are obtained used the noted ATRP process as described in U.S. Pat. No. 5,763,548 (noted above), the disclosure of which is incorporated by reference herein in its entirety. In such processes, one or more radically polymerizable monomers are polymerized in the presence of an initiator having a radically transferable atom or group, a transition metal compound and a ligand to form a copolymer. The transition metal compound generally can be represented by the formula $Mt^{n+}X^{n-}$. The ligand can be a nitrogen, oxygen, phosphorus or sulfur containing compound that can coordinate in a s-bond, or any carbon-containing compound that can coordinate in a p-bond to the transition metal, such as direct (that is covalent) bonds between a transition metal and growing polymer radical are not formed. Such processes provide a high degree of control over polymerization and allows the formation of various polymers and copolymers with more uniform properties.

Specific examples of hyperbranched segments that may be used in the hyperbranched polymers, include but are not limited to, polymers derived from one or more of "branching monomers" such as m-vinyl benzylchloride, p-vinyl benzylchloride, m,p-vinyl benzylchloride, trichloroethyl acrylate, trichloroethyl methacrylate, α-chloroacrynitrile, α-chloroacrylate, α-chloroacrylic acid, α-bromomalcic anhydride, α-chloromaleic anhydride, 2-(2-chloropropionyloxy)ethyl acrylate, 2-(2-bromopropionyloxy)ethyl acrylate, 2-(2-chloropropionyloxy)ethyl methacrylate and 2-(2-bromopropionyloxy)ethyl methacrylate.

The heat-sensitive hyperbranched polymers useful in this invention generally have a molecular weight ranging from 200 to 10,000,000, preferably from 500 to 1,000,000, more preferably from 1,000 to 100,000, and most preferably at least 8000. Mixtures of hyperbranched polymers, having the same or different molecular weights and the same or different heat-sensitive active end groups, can be used in preparing the imaging member of this invention.

More particularly, the heat-sensitive hyperbranched polymers useful in the practice of this invention comprise heat-sensitive active end groups "Fr" that can be represented by any of the following structures I–IV. Preferably, the heat-sensitive active end group Fr can be a thiosulfate group as represented by the structure I:

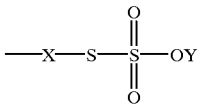

wherein X is a divalent linking group, Y is a cation such as hydrogen, a quarternized ammonium ion or a metal ion (for example, sodium, potassium, magnesium, lithium, calcium, barium and zinc). Preferably, Y is hydrogen or a sodium or potassium ion.

Useful X linking groups include substituted or unsubstituted, branched or linear alkylene groups having 1 to 6 carbon atoms (such as methylene, ethylene, n-propylene, isopropylene and butylenes), —COTX'— wherein T is oxy or —NH— and X' includes one or more substituted or unsubstituted, branched or linear aliphatic groups having 1 to 6 carbon atoms in the form of alkylene groups (such as methylene, ethylene, n-propylene, n-butylene, isopropylene and n-hexylene) that can be connected with one or more oxygen, nitrogen or sulfur atoms in the chain, substituted or unsubstituted arylene groups having 6–14 carbon atoms in the rings (such as phenylene, naphthalene, anthracylene and xylylene), substituted or unsubstituted arylenealkylene groups (or alkylenearylene groups) having 7 to 20 carbon atoms (such as p-methylenephenylene, phenylenemethylenephenylene, biphenylene and phenyleneisopropylenephenylene). Preferably, X is —COOX'— wherein X' is ethylene, n-propylene or n-butylene, or X is a phenylenemethylene group. More preferably X is —COOX'— wherein X' is ethylene or n-propylene.

The heat-sensitive active end group Fr can also be heteroatom-based "oiganoonium" salt represented by structure II:

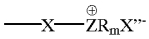

wherein X is a divalent linking group as described above. Z is nitrogen, sulfur, or phosphorus, R is a substituted or unsubstituted alkyl group, m is 3 or 4, and X" is a monovalent or divalent anion such as chloride, bromide, fluoride, acetate, nitrate, sulfate, tosylate or carbonate.

In addition, the group Fr can be sulfonate group represented by structure III:

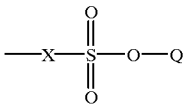

wherein X is a divalent linking group as defined above, and Q is selected from several types of groups. In one instance, Q can be represented by structure IIIa:

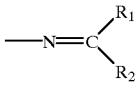

wherein $R_1$ and $R_2$ are independently hydrogen, a substituted or unsubstituted alkyl group having 1 to 10 carbon atoms (such as methyl, ethyl, isopropyl, n-hexyl, 2-ethylhexyl and n-butyl), a substituted or unsubstituted acyl group having 2 to 10 carbon atoms (such as acetyl), or a substituted or unsubstituted carbocyclic or heterocyclic aromatic group (such as phenyl, naphthyl and anthryl). Alternatively, $R_1$ and $R_2$ taken together can provide the atoms necessary to form a substituted or unsubstituted alicyclic ring having from 5 to 15 carbon, oxygen, nitrogen or sulfur atoms in the ring (such as cyclohexyl, cyclohexenyl, terolonyl and flurenyl rings). Such ring structures are usually nonaromatic in character. Preferably, $R_1$ and $R_2$ are taken together to provide atoms necessary to form an alicyclic ring having from 5 to 15 carbon atoms in the ring, and more preferably they form an unsubstituted alicyclic ring having from 6 to 14 carbon atoms in the ring. More preferably, $R_1$ and $R_2$ form a ring derived from α-tetralone, fluorenone or cyclohexanone.

Still further, Q can be an alkyl group represented by structure IIIb:

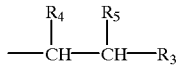

wherein $R_5$ is an electron withdrawing group, and $R_3$ and $R_4$ are independently hydrogen or a substituted or unsubstituted alkyl group having 1 to 10 carbon atoms as defined above for $R_1$ and $R_2$.

An electron withdrawing group is generally known to have a positive Hammett sigma value, and preferably a Hammett sigma value greater than 0.06. Hammett sigma values can be calculated using standard procedures described for example, in *Steric Effects in Organic Chemistry* (John Wiley & Sons, Inc. 1956, pp.570–574) and in *Progress in Physical Organic Chemistry* (Vol. 2, Interscience Publishers, 1964, pp333–339). Representative useful electron withdrawing groups include, but are not limited to, cyano, sulfo, carboxy, nitro, halo (for example, fluoro and chloro), trihaloalkyl (such as trichloromethyl), trialkylammonium, carbamoyl, sulfamoyl, sulfinyl, pyridinyl, a substituted and unsubstituted aryl group having 6 to 10 carbon atoms in the ring (particularly aryl groups substituted with one or more electron withdrawing groups). Preferably, the electron withdrawing group is sulfo, carboxy, nitro, or a substituted or unsubstituted phenyl group, and most preferably, it is sulfo or a phenyl group.

Further, the Q can be represented by structure IIIc:

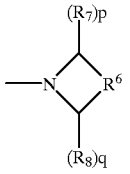

wherein $R_6$ is a divalent aliphatic group having 2 to 11 carbon, nitrogen, oxygen or sulfur atoms. Preferably, $R_6$ is a substituted or unsubstituted alkylene group having 2 to 10 atoms, and more preferably, the alkylene group has 2 or 3 carbon atoms that are unsubstituted. $R_7$ and $R_8$ are independently hydrogen, thio or oxo, and p and q are independently 1 or 2 so that the valences of the carbon atoms are appropriately filled. More preferably, both of $R_7$ and $R_8$ are oxo.

Yet again, the heat-sensitive active end group Fr can be represented by structure IV:

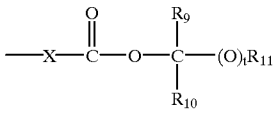

wherein X is a divalent linking group as defined above, $R_9$, $R_{10}$, and $R_{11}$ are hydrogen or substituted and unsubstituted alkyl or aromatic groups having 1 to 18 atoms as described above, or any two of these three groups can together form a carbocyclic ring, and t is 0 or 1. Preferably two of the noted groups form a 5- or 6-membered carbocyclic ring.

The heat-sensitive active end groups can be the end groups (or termini) of hyperbranched polymers or they can be part of the branches resulting from the non-branching monomers. Preferably such groups are part of ethylenically unsaturated polymerizable monomers that can be polymerized using known living or controlled polymerization methods to form hyperbranched vinyl homopolymers or copolymers. Alternatively, the polymers can also be prepared from modification reaction of pre-formed hyperbranched polymers. Modification of preformed polymers generally involves two steps: (1) production of a hyperbranched polymer or copolymer with multiple active end functional groups by means of known living or controlled polymerization methods, and (2) reaction of such active hyperbranched polymers or copolymers with an active compound containing heat-sensitive active end groups to form heat-sensitive hyperbranched polymers. A wide variety of known organic reactions can be used to produce hyperbranched polymers containing such groups. Such reactions include quaternization, condensation, alkylation, etherfication, esterfication and substitution. Such known reactions are described for example by March, *Advanced Organic Chemistry: Reactionis, Mechanisms, and Struture* (Fourth Edition, John Wiley & Son, New York, 1992).

Each hyperbranched polymer useful in the practice of this invention generally contains from 2 to 100,000 heat-sensitive active end groups, preferably 5 to 10,000 of such groups, more preferably 10 to 1,000 of such groups, and most preferably at least 80 of such groups.

Thiosulfate-containing molecules (or Bunte salts) in general can be prepared from the reaction between alkyl halide (RHal) and thiosulfate salt as described in Bunte, H. *Chem. Ber*. 1884, 7, 646.

Organoonium salts can be prepared from alkyl halide and tertiary amines, trialkyl phosphines or dialkyl sulfides as described March, *Advaced Organic Chemistry*, p 411, John Wiley &Sons, New York, 1992, 4th Edition. Various counter anions can be obtained by ion exchange the above molecules.

Hyperbranched polymers containing the noted heat-sensitive active end groups can either be prepared from functional monomers or from preformed polymer.

Representative synthetic methods for making polymers useful in the practice of this invention are illustrated as follows:

SYNTHESIS EXAMPLE 1

Synthesis of poly(vinyl benzyl thiosulfate sodium salt) from polymer—linear polymer 1:

Vinyl benzyl chloride (21.5 g, 0.141 mol) and azobisisobutylronitrile (hereafter referred to as "AIBN") (0.25 g, 1.5 mmol) were dissolved in 50 ml of toluene. The solution was purged with dry nitrogen and then heated at 65° C. overnight. After cooling to room temperature, the solution was diluted to 100 ml and added dropwise to 1000 ml of isopropanol. The resulting white powdery polymer was collected by filtration and dried under vacuum at 40° C. overnight providing a yield of 57%. A gel permeation chromatographic (GPC) analysis of polymer gave weight average molecular weight ($M_w$) of 58,500, and a molecular weight distribution (the ratio of weight average molecular weight to number average molecular weight, $M_w/M_n$) of 1.5.

The above polymer (10 g) was dissolved in 150 ml of N,N-dimethylformamide (DMF). To this solution was added sodium thiosulfate (10.44 g, 0.066 mol) and 30 ml of water. Some polymer precipitated out. The cloudy reaction mixture was heated at 95° C. for 12 hours. After cooling to room temperature, the hazy reaction mixture was transferred to a dialysis membrane [molecular weight cut off (MWCO) of 1,000] and dialyzed against water. Small amount of the resulting polymer solution was freeze dried for elemental analysis and the rest of the polymer solution was subject to imaging testing. Elemental analysis indicated the reaction conversion was 99 mol %.

SYNTHESIS EXAMPLE 2

Synthesis of hyperbranched poly(vinyl benzyl thiosulfate sodium )—

Polymer 2:

Commercially available p-chloromethyl styrene (50 g), CuCl (0.715 g), and 2,2'-dipyridyl (1.56 g), and diphenyl ether (50 ml) (all available from Aldrich Chemical Co.) were mixed in a reaction flask. The mixture was purged with dry nitrogen gas for about 15 minutes and then heated at 120 to 130° C. for 19.5 hours. The resulting solid was dissolved in tetrahydrofuran (THF) and precipitated into cool methanol/water (50/50 v/v) mixture. The resulting polymer was recovered by filtering through a glass frit funnel and dried under vacuum at 60° C. for 18 hours with 88% yield. An analysis of polymer by GPC gave a weight average molecular weight ($M_w$) of 26,900 and a and molecular weight distribution of 3.8.

The above polymer (3.0 g) was dissolved in 50 ml of DMF. To this solution was added sodium thiosulfate (3.2 g, 0.02 mol) and 10 ml of water. The cloudy reaction mixture was heated at 95° C. for 8 hours. After cooling to room temperature, the hazy reaction mixture was transferred to a dialysis membrane (MWCO 500) and dialyzed against water. The resulting solution was then concentrated and subjected to imaging testing.

SYNTHESIS EXAMPLE 3

Synthesis of linear poly(vinyl benzyl thiosulfate sodium salt-co-methyl methacrylate) from polymer Polymer 3:

Vinyl benzyl chloride (10 g, 0.066 mol), methyl methacrylate (15.35 g, 0.153 mol), and AIBN (0.72 g, 4 mmol) were dissolved in 120 ml of toluene. The solution was purged with dry nitrogen and then heated at 65° C. overnight. After cooling to room temperature, the solution was dropwise to 1200 ml of isopropanol. The white powdery polymer was collected by filtration and dried under vacuum at 60° C. overnight with a yield of 78%. $^1$H NMR analysis indicated that the copolymer contained 44 mol % of vinyl benzyl chloride.

The above polymer (16 g) was dissolved in 110 ml of DMF. To this solution was added sodium thiosulfate (12 g) and 20 ml of water. Some polymer precipitated out. The cloudy reaction mixture was heated at 90° C. for 24 hours. After cooling to room temperature, the hazy reaction mixture was transferred to a dialysis membrane (MWCO 1,000) and dialyzed against water. A small amount of the resulting polymer solution was freeze dried for elemental analysis and the rest of the polymer solution was subject to imaging testing. Elemental analysis indicated that all of the vinyl benzyl chloride was converted to sodium thiosulfate salt.

SYNTHESIS EXAMPLE 4

Synthesis of hyperbranched poly(vinyl benzyl thiosulfate sodium-co-methyl methacrylate)—

Polymer 4:

Commercially available p-chloromethyl styrene (10 g), methyl methacrylate (10 g), CuCl (0.35 g), and 2,2'-dipyridyl (0.8 g) were mixed in a reaction flask. The mixture was purged with dry nitrogen gas for about 15 minutes and then heated at 110 to 120° C. for 3.75 hours. The resulting solid was dissolved in 100 ml of THF and then precipitated into 2 liters of cool methanol/water (50/50 v/v) mixture. The polymer was recovered by filtration and dried under vacuum at 60° C. for 18 hours with 50% yield. An analysis of polymer by GPC gave weight average molecular weight ($M_w$) of 44,200 and a molecular weight distribution of 5.8. The molar composition of methyl methacrylate in the copolymer was determined to be 40% by means of $^1$H NMR.

The above polymer (4.66 g) was dissolved in 50 ml of DMF. To this solution was added sodium thiosulfate (5.8 g, 0.037 mol) and 10 ml of water. The cloudy reaction mixture was heated at 90° C. for 26 hours. After cooling to room temperature, the hazy reaction mixture was transferred to a dialysis membrane and dialyzed against water. The resulting solution was then concentrated and subjected to imaging testing.

SYNTHESIS EXAMPLE 5

Synthesis of hyperbranched poly(vinyl benzyl thiosulfate sodium-co-t-butyl methacrylate)—

Polymer 5:

Commercially available p-chloromethyl styrene (20 g), t-butyl acrylate (30 g), CuCl (0.75 g), and 2,2'-dipyridyl (1.5 g) were mixed in a reaction flask. The mixture was purged with dry nitrogen gas for about 15 minutes and then heated at 11 to 120° C. for 1.5 hours. The resulting solid was dissolved in THF and precipitated into cool methanol/water (50/50 v/v) mixture. The polymer was recovered by filtering through a glass frit funnel and dried under vacuum at 60° C. for 18 hours with 60% yield. An analysis of polymer by GPC gave weight average molecular weight ($M_w$) of 192,000 and a molecular weight distribution of 27.5. The molar composition of t-butyl acrylate in the copolymer was determined to be 43% by means of $^1$H NMR.

The above polymer (2.2 g) was dissolved in 40 ml of DMF. To this solution was added sodium thiosulfate (1.6 g, 0.01 mol) and 8 ml of water. The cloudy reaction mixture was heated at 90° C. for 21 hours. After cooling to room temperature, the hazy reaction mixture was transferred to a dialysis membrane and dialyzed against water for 24 hours. The resulting solution was then concentrated and subjected to imaging testing.

SYNTHESIS EXAMPLE 6

Synthesis of hyperbranched poly(vinyl benzyl thiosulfate sodium-co-t-butyl acrylate)—

Polymer 6:

Commercially available p-chloromethyl styrene (5 g), t-butyl acrylate (5 g), toluene (10 g), CuCl (0.15 g), and 2,2'-dipyridyl (0.3 g) were mixed in a reaction flask. The mixture was purged with dry nitrogen gas for about 15 minutes and then heated at 110 to 120° C. for 2 hours. The resulting solution was dissolved in 10 ml of THF and precipitated into a cooled methanol/water (50/50 v/v) mixture. The polymer was recovered by filtration and dried under vacuum at 60° C. for 18 hours with a 0.50% yield. An analysis of the polymer by GPC gave an weight average molecular weight ($M_w$) of 33,400 and a molecular weight of 4.2. The molar composition of t-butyl acrylate in the copolymer was determined to be 35% by means of $^1$H NMR.

The above polymer (2.2 g) was dissolved in 40 ml of DMF. To this solution was added sodium thiosulfate (1.9 g, 0.012 mol) and 8 ml of water. The cloudy reaction mixture was heated at 90° C. for 24 hours. After cooling to room temperature, the hazy reaction mixture was transferred to a dialysis membrane and dialyzed against. The resulting solution was then concentrated and subjected to imaging testing.

Vinyl polymers can be prepared by copolymerizing monomers containing the thiosulfate functional groups with one or more other ethylenically unsaturated polymerizable monomers to modify polymer chemical or functional properties, to optimize imaging member performance, or to introduce additional crosslinking capability.

Useful additional ethylenically unsaturated polymerizable monomers include, but arc not limited to, acrylates (including methacrylates) such as ethyl acrylate, n-butyl acrylate, methyl methacrylate and t-butyl methacrylate, acrylamides (including methacrylamides), an acrylonitrile (including methacrylonitrile), vinyl ethers, styrenes, vinyl acetate, dienes (such as ethylene, propylene, 1,3-butadiene and isobutylene), vinyl pyridine and vinylpyrrolidone. Acrylamides, acrylates and styrenes are preferred.

Polyesters, polyamides, polyimides, polyurethanes and polyethers are prepared from conventional starting materials and using known procedures and conditions.

A mixture of heat-sensitive polymers described herein can be used in the imaging layer of the imaging members, but preferably only a single polymer is used. The polymers can be crosslinked or uncrosslinked when used in the imaging layer. If crosslinked, the crosslinkable moiety is preferably provided from one or more of the additional ethylenically unsaturated polymerizable monomers when the polymers are vinyl polymers. The crosslinking cannot interfere with the heat activation of the thiosulfate group during imaging.

The imaging layer of the imaging member can include one or more of such homopolymers or copolymers, with or without minor (less than 20 weight % based on total layer dry weight) amounts of additional binder or polymeric materials that will not adversely affect its imaging properties. However, the imaging layer includes no additional materials that are needed for imaging, especially those materials conventionally required for wet processing with alkaline developer solutions (such as novolak or resole resins).

The amount of heat-sensitive polymer(s) used in the imaging layer is generally at least 0.1 $g/m^2$, and preferably from about 0.1 to about 10 $g/m^2$ (dry weight). This generally provides an average dry thickness of from about 0.1 to about 10 $\mu$m.

The imaging layer can also include one or more conventional surfactants for coatability or other properties, or dyes or colorants to allow visualization of the written image, or any other addenda commonly used in the lithographic art, as long as the concentrations are low enough so that they are inert with respect to imaging or printing properties.

The heat-sensitive composition in the imaging layer preferably includes one or more photothermal conversion materials to absorb appropriate energy from an appropriate source (such as a laser), which radiation is converted into heat. Thus, such materials convert photons into heat phonons. Preferably, the radiation absorbed is in the infrared and near-infrared regions of the electromagnetic spectrum by the infrared radiation absorbing materials. Such materials can be dyes, pigments, evaporated pigments, semiconductor materials, alloys, metals, metal oxides, metal sulfides or combinations thereof, or a dichroic stack of materials that absorb radiation by virtue of their refractive index and thickness. Borides, carbides, nitrides, carbonitrides, bronze-structured oxides and oxides structurally related to the bronze family but lacking the $WO_{2.9}$ component, are also useful. One particularly useful pigment is carbon of some form (for example, carbon black). The size of the pigment particles should not be more than the thickness of the layer. Preferably, the size of the particles will be half the thickness of the layer or less. Useful absorbing dyes for near infrared diode laser beams are described, for example, in U.S. Pat. No. 4,973,572 (DeBoer), incorporated herein by reference. Particular dyes of interest are "broad band" dyes, that is those that absorb over a wide band of the spectrum. Mixtures of pigments, dyes, or both, can also be used. Particularly useful infrared radiation absorbing dyes and pigments include those illustrated as follows:

IR Dye 1

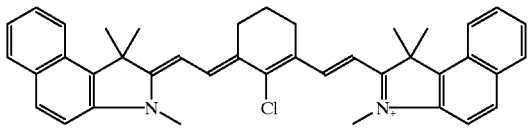

p-Toluenesulfonate

IR Dye 2

Same as IR Dye 1 but with $C_3F_7CO_2^-$ as the anion.

IR Dye 3

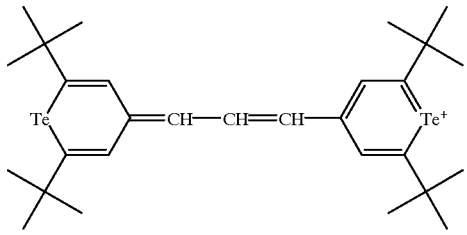

IR Dye 4

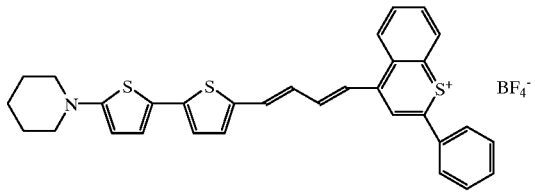

IR Dye 5

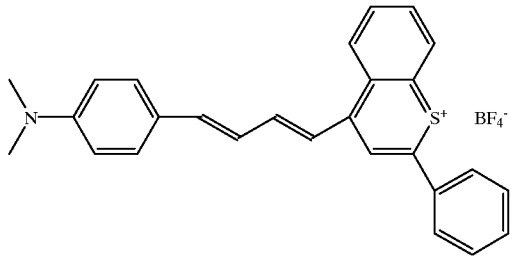

IR Dye 6

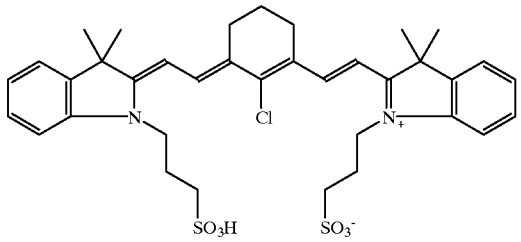

IR Dye 7 Same as IR Dye 1 but with chloride as the anion

The photothermal conversion material(s) are generally present in the imaging layer in an amount sufficient to provide an optical density of at least 0.3, and preferably at least 1.0, at the operating wavelength of the imaging laser. The particular amount needed for this purpose would be readily apparent to one skilled in the art, depending upon the specific material used.

Alternatively, a photothermal conversion material can be included in a separate layer that is in contact with the heat-sensitive imaging layer. Thus, during imaging, the action of the photothermal conversion material can be transferred to the heat-sensitive imaging layer without the material originally being in the same layer.

The heat-sensitive composition can be applied to a support using any suitable equipment and procedure, such as spin coating, knife coating, gravure coating, dip coating or extrusion hopper coating.

The imaging members of this invention can be of any useful form including, but not limited to, printing plates, printing cylinders, printing sleeves and printing tapes (including flexible printing webs). Preferably, the imaging members are lithographic printing plates.

Printing plates can be of any useful size and shape (for example, square or rectangular) having the requisite heat-sensitive imaging layer disposed on a suitable support. Printing cylinders and sleeves are known as rotary printing members having the support and heat-sensitive layer in a cylindrical form. Hollow or solid metal cores can be used as substrates for printing sleeves.

During use, the imaging member of this invention can be exposed to any suitable source of energy that generates or provides heat, such as a focused laser beam or thermoresistive head, in the imaged areas, typically from digital information supplied to the imaging device. A laser used to expose the imaging member of this invention is preferably a diode laser, because of the reliability and low maintenance of diode laser systems, but other lasers such as gas or solid state lasers may also be used. The combination of power, intensity and exposure time for laser imaging would be readily apparent to one skilled in the art. Specifications for lasers that emit in the near-IR region, and suitable imaging configurations and devices are described in U.S. Pat. No. 5,339,737 (Lewis et al), incorporated herein by reference. The imaging member is typically sensitized so as to maximize responsiveness at the emitting wavelength of the laser. For dye sensitization, the dye typically is chosen such that its $\lambda_{max}$ closely approximates the wavelength of laser operation.

The imaging apparatus can operate on its own, functioning solely as a platemaker, or it can be incorporated directly into a lithographic printing press. In the latter case, printing may commence immediately after imaging, thereby reducing press set-up time considerably. The imaging apparatus can be configured as a flatbed recorder or as a drum recorder, with the imaging member mounted to the interior or exterior cylindrical surface of the drum.

In the drum configuration, the requisite relative motion between the imaging device (such as a laser beam) and the imaging member can be achieved by rotating the drum (and the imaging member mounted thereon) about its axis, and moving the imaging device parallel to the rotation axis, thereby scanning the imaging member circumferentially so the image "grows" in the axial direction. Alternatively, the imaging device can be moved parallel to the drum axis and, after each pass across the imaging member, increment angularly so that the image "grows" circumferentially. In both cases, after a complete scan an image corresponding (positively or negatively) to the original document or picture can be applied to the surface of the imaging member.

In the flatbed configuration, a laser beam is drawn across either axis of the imaging member, and is indexed along the other axis after each pass. Obviously, the requisite relative motion can be produced by moving the imaging member rather than the laser beam.

While laser imaging is preferred in the practice of this invention, any other imaging means can be used that provides thermal energy in an imagewise fashion. For example, imaging can be accomplished using a thermoresistive head (or thermal printing head) in what is known as "thermal printing", as described for example, in U.S. Pat. No. 5,488,025 (Martin et al), incorporated herein by reference. Such thermal printing heads are commercially available (for example as Fujitsu Thermal Head FTP-040 MCS001 and TDK Thermal Head F415 HH7-1089).

After imaging, the imaging member can be used for printing either with or without conventional wet processing using conventional developers or water. Printing is accomplished by applying a lithographic ink to the image on its printing surface, with a fountain solution, and by transferring the ink to a suitable receiving material (such as cloth, paper, metal, glass or plastic) to provide a desired impression of the image thereon. If desired, an intermediate "blanket" roller can be used in the transfer of the ink from the imaging member to the receiving material. The imaging members can be cleaned between impressions, if desired, using conventional cleaning means.

The following examples illustrate the practice of the invention, and are not meant to limit it in any way.

In these examples, a thermal IR-laser platesetter was used to image the printing plates, the printer being similar to that described in U.S. Pat. No. 5,168,288 (Back et al), incorporated herein by reference. The printing plates were exposed using approximately 450 mW per channel, 9 channels per swath, 945 lines/cm, a drum circumference of 53 cm and an image spot (1/e2) at the image plane of about 25 $\mu$m. The test image included text, positive and negative lines, half tone dot patterns and a half-tone image. Images were printed at speeds up to 1100 revolutions per minute (the exposure levels do not necessarily correspond to the optimum exposure levels for the tested printing plates).

Examples 1–4

Imaging Members Containing Linear and Hyperbranched Polymers Developed On Press Heat-sensitive imaging formulations were prepared from the following components:

| | |
|---|---|
| Polymers 1, 2, 3, 4, 5 or 6 | 0.20 g |
| IR Dye 6 | 0.02 g |
| Water | 4.00 g |
| Methanol | 1.00 g |

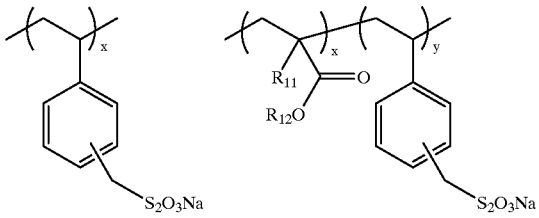

-continued polymer 1: linear polymer 2: hyperbranched

| | $R_{11}$ | $R_{12}$ | x | y | architecture |
|---|---|---|---|---|---|
| polymer 3 | methyl | methyl | 56 | 44 | linear |
| polymer 4 | methyl | methyl | 40 | 60 | hyperbranched |
| polymer 5 | H | t-butyl | 43 | 57 | hyperbranched |
| polymer 6 | H | t-butyl | 35 | 65 | hyperbranched |

Each formulation containing 4.21 weight % of solids was coated at 100 mg/ft$^2$ of dry coverage (1.08 g/m$^2$) onto 0.10 mm gelatin subbed poly(ethylene terephthalate) support using conventional coating methods. The resulting printing plates were dried in a convection oven at 82° C. for 3 minutes, clamped on the rotating drum of a conventional platesetter and were digitally exposed to an 830 nm laser printhead at dosages ranging from 550 to 1350 mJ/cm$^2$. The blue-green coating rapidly discolored to a typically off-white color in the exposed regions.

A sample of each of the laser exposed plates was then mounted on the plate cylinder of a full page, commercially available A. B. Dick lithographic duplicator press for actual press run using Varn Universal Pink fountain solution and a commercial black ink. The fountain solution simultaneously acts as a developer to clean out and desensitize the unexposed areas of the plates. Each plate rolled up fast and printed with full density for at least a thousand printed sheets. The press results are summarized in TABLE I below.

TABLE I

| Example | Polymer | Architecture | Press Results |
|---|---|---|---|
| Control A | 1 | linear | normal speed and roll-up |
| 1 | 2 | hyperbranched | higher speed and faster roll-up |
| Control B | 3 | linear | normal speed and roll-up |
| 2 | 4 | hyperbranched | higher speed and faster roll-up |
| 3 | 5 | hyperbranched | higher speed and faster roll-up |
| 4 | 6 | hyperbranched | higher speed and faster roll-up |

These results directly compare press performance of Control printing plates containing linear polymers (Polymers 1 and 3) in the imaging layer with Invention printing plates containing hyperbranched polymers (Polymers 2 and 4) in the imaging layers. While both sets of the plates performed satisfactorily on press, the Invention printing plates clearly outperformed the Control printing plates with significantly higher photospeed and faster roll-up. Similar results were obtained with printing plates containing hyperbranched Polymers 5 and 6.

Examples 5–8

Imaging Members Containing Linear and Hyperbranched Polymers Developed On Press Or With Tap Water Other imaging members were similarly prepared as described above except they were prepared using a commercially available support material known as MYRIAD 2, which is a hydrophilic ceramic coated on 0.1 mm polyester base (available from Xanté Corporation). The imaging and printing results are shown in TABLE II below.

TABLE II

| Example | Polymer | Architecture | Developer | Press Results |
|---|---|---|---|---|
| Control C | 1 | linear | tap water | normal speed and roll-up |
| 5 | 2 | hyperbranched | tap water | higher speed and faster roll-up |
| Control D | 3 | linear | tap water | normal speed and roll-up |
| 6 | 4 | hyperbranched | tap water | higher speed and faster roll-up |
| 7 | 5 | hyperbranched | on press | higher speed and faster roll-up |
| 8 | 6 | hyperbranched | on press | higher speed and faster roll-up |

The plates were similarly exposed on a platesetter and developed either on press using a fountain solution or by simply rinsing off the unexposed areas of the plates using tap water. Various methods of development and test results using an A. B. Dick press are summarized in TABLE II. The plates of the present invention consistently produced higher photospeed and faster roll-up.

The invention has been described in detail with particular reference to preferred embodiments thereof but it will be understood that variations and modifications can be effected within the spirit and scope of the invention.

We claim:

1. A heat-sensitive imaging member comprising a support having thereon a heat-sensitive imaging layer comprising a heat-sensitive hyperbranched polymer containing at least 10 heat-sensitive active end groups.

2. The imaging member of claim 1 further comprising a photothermal conversion material.

3. The imaging member of claim 2 wherein said photothermal conversion material is in said heat-sensitive imaging layer.

4. The imaging member of claim 2 wherein said photothermal conversion material is an infrared radiation absorbing material.

5. The imaging member of claim 1 wherein said hyperbranched polymer comprises one or more hyperbranched polymer segments HPB-$(Fr)_n$ wherein Fr is a heat-sensitive active end group and n is an integer of 2 or more, provided said hyperbranched polymer comprises at least 10 heat-sensitive active end groups.

6. The imaging member of claim 5 wherein said hyperbranched polymer is of a vinyl polymer.

7. The imaging member of claim 5 wherein said heat-sensitive active end group Fr is:

a) a thiosulfate group of structure I

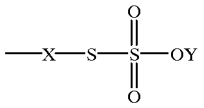

wherein X is a divalent linking group, and Y is a cation, b) a heteroatom-based organoonium salt of structure II:

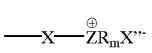

wherein X is as defined above, Z is nitrogen, sulfur, or phosphorus, R is an alkyl group, m is 3 or 4, and $X''^-$ is a monovalent or divalent anion, c) a sulfonate group of structure III:

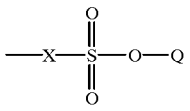

wherein X is as defined above, and

Q is an imino group of structure IIIa:

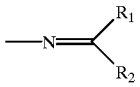

wherein $R_1$ and $R_2$ are independently hydrogen, an alkyl group, an acyl group, or an aromatic group, or $R_1$ and $R_2$ taken together form an alicyclic ring, an alkyl group of structure IIIb:

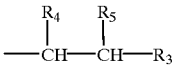

wherein $R_3$ represents a electron withdrawing group, and $R_4$ and $R_5$ are independently hydrogen atom or an alkyl group, or an imide group of structure IIIc:

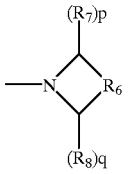

wherein $R_6$ is a divalent aliphatic group, $R_7$ and $R_8$ are independently hydrogen, thio or oxo, and p and q are independently 1 or 2 so that the valences of the carbon atoms are appropriately filled, or d) a carboxylate group of structure IV:

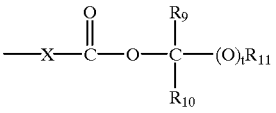

wherein X is as defined above, and $R_9$, $R_{10}$, and $R_{11}$ are independently hydrogen, an alkyl group or an aromatic group, or any two of $R_9$, $R_{10}$ and $R_{11}$ together can form a carbocyclic ring, and t is 0 or 1.

8. The imaging member of claim 7 wherein X is —COOX' wherein X' is ethylene, n-propylene or n-butylene, or X is a phenylenemethylene group, Y is hydrogen or a sodium or potassium ion, Q is the imino group of structure IIIa, $R_1$ and $R_2$ form an unsubstituted alicyclic ring having from 5 to 15 atoms in the ring, $R_5$ is sulfo, carboxy, nitro or a phenyl group, $R_6$ is an alkylene group of 2 or 3 carbon atoms, and $R_7$ and $R_8$ are both oxo.

9. The imaging member of claim 7 wherein Fr is said thiosulfate group of structure I.

10. The imaging member of claim 1 wherein said heat-sensitive imaging layer is the sole layer on said support.

11. The imaging member of claim 1 wherein said heat-sensitive hyperbranched polymer has a molecular weight of from about 200 to about 10,000,000.

12. The imaging member of claim 11 wherein said heat-sensitive hyperbranched polymer has a molecular weight of at least 8000.

13. The imaging member of claim 1 wherein said heat-sensitive hyperbranched polymer contains from 10 to 100,000 heat-sensitive active end groups.

14. The imaging member of claim 13 wherein said heat-sensitive hyperbranched polymer contains at least 80 heat-sensitive active end groups.

15. The imaging member of claim 1 having a polyester, metal or a ceramic laminated polyester support.

16. The imaging member of claim 1 that is a lithographic printing plate.

17. A method of imaging comprising the steps of:

A) providing the imaging member of claim 1, and

B) imagewise exposing said imaging member to provide exposed and unexposed areas in said imaging layer of said imaging member, whereby said exposed areas are rendered either more hydrophobic or more hydrophilic than said unexposed areas by heat generated by said imagewise exposing.

18. The method of claim 17 wherein said imaging member further comprises a photothermal conversion material and said imagewise exposing is carried out using an IR radiation emitting laser.

19. The method of claim 17 wherein said imagewise exposing is carried out using a thermal printing head.

20. A method of printing comprising the steps of:

A) providing the imaging member of claim 1,

B) imagewise exposing said imaging member to provide exposed and unexposed areas on the surface of said imaging member, whereby said exposed areas are rendered either more hydrophobic or more hydrophilic than said unexposed areas by heat generated by said imagewise exposing, and C) contacting said imagewise exposed imaging member with a lithographic printing ink, and imagewise transferring said printing ink from said imaging member to a receiving material.

21. A method of imaging comprising the steps of:

A) providing the imaging member of claim 1, wherein said heat-sensitive hyperbranched polymer comprises one or more hyperbranched polymer segments HPB-$(Fr)_n$ wherein Fr is a heat-sensitive active end group and n is an integer of 2 or more, and B) imagewise exposing said imaging member to provide exposed and unexposed areas in said imaging layer of said imaging member, whereby said exposed areas are rendered more hydrophobic than said unexposed areas by heat generated by said imagewise exposing.

22. A method of imaging comprising the steps of:

A) providing the imaging member of claim 1, wherein said heat-sensitive hyperbranched polymer comprises one or more hyperbranched polymer segments HPB-$(Fr)_n$ wherein Fr is a heat-sensitive active end group and n is an integer of 2 or more, and B) imagewise exposing said imaging member to provide exposed and unexposed areas in said imaging layer of said imaging member, whereby said exposed areas are rendered more hydrophilic than said unexposed areas by heat generated by said imagewise exposing.

23. The imaging member of claim 1 wherein said heat-sensitive hyperbranched polymer comprises from 10 to 10,000 of said heat-sensitive active end groups.

24. The imaging member of claim 23 wherein said heat-sensitive hyperbranched polymer comprises from 10 to 1000 of said heat-sensitive active end groups.

* * * * *